United States Patent [19]

Pease et al.

[11] 4,017,110

[45] Apr. 12, 1977

[54] CYLINDER AND PISTON ASSEMBLY

[75] Inventors: Bobbylee Pease, Battle Creek; Clark C. Simpson, Martin, both of Mich.

[73] Assignee: Clark Equipment Company, Buchanan, Mich.

[22] Filed: May 19, 1975

[21] Appl. No.: 578,445

[52] U.S. Cl. ..... 294/81 SF; 214/620; 91/217; 91/414

[51] Int. Cl.[2] ..... F01B 15/02; B66C 1/66; F15B 13/06

[58] Field of Search ..... 91/167 R, 173, 216 R, 91/216 A, 414, 217; 294/81 SF, 67 DA, 67 R, 81 R; 214/620

[56] References Cited

UNITED STATES PATENTS

| | | | |
|---|---|---|---|
| 3,070,071 | 12/1962 | Cooper | 91/173 |
| 3,187,637 | 6/1965 | Edmund | 91/167 R |
| 3,245,560 | 4/1966 | Killebrew | 214/140 |
| 3,266,377 | 8/1966 | Panissidi | 91/167 R |
| 3,576,269 | 4/1971 | Shaffer | 294/67 R |
| 3,750,814 | 8/1973 | Allegri | 294/67 DA |
| 3,752,346 | 8/1973 | Thompson et al. | 294/67 DA |

FOREIGN PATENTS OR APPLICATIONS

| | | | |
|---|---|---|---|
| 342,864 | 1/1960 | Switzerland | 91/216 R |

*Primary Examiner*—Paul E. Maslousky
*Attorney, Agent, or Firm*—John C. Wiessler

[57] ABSTRACT

A hydraulic cylinder assembly in which cylinders are separated into two coaxial cylindrical portions sealed hydraulically one from the other, one having an extensible piston therein and the other being extensible together with the extensible piston on a fixed supporting piston. In an exemplary embodiment two such cylinder assemblies are mounted to operate in opposite directions within various predetermined fixed limits of extension to control the extension of a telescopic spreader frame for handling containers to selected ones of such fixed limits. For different combinations of such fixed limits of extension in one or more selected installations, different length spacers are used at the time of assembly in the cylinder assemblies to establish various fixed and predetermined intermediate extensions between full extension and full retraction thereof. A hydraulic control system for the cylinder assemblies includes first and second valves and conduits variously connecting the valves to both cylinder portions of both cylinder assemblies.

19 Claims, 11 Drawing Figures

CYLINDER AND PISTON ASSEMBLY

BACKGROUND OF THE INVENTION

The field of art to which the invention pertains relates to compound cylinder and piston assemblies for actuating telescopic spreader frames for the handling of cargo containers, and more particularly to such compound assemblies in a hydraulic system which together is adapted to actuate the spreader frame to predetermined fixed positions of full extension and retraction, and to one of a plurality of preselected fixed positions intermediate full extension and retraction.

The present invention, as applied herein to an exemplary embodiment, other applications of which will be apparent to persons skilled in the art, is concerned with a type of spreader frame capable of handling a variety of types and sizes of cargo containers which, as a complex of containers and container handling equipment in the transportation industry, has become to be known as "containerization".

Differences in cargo container length have necessitated either the use of individual spreader frames of different sizes or expansible spreader frames capable of adjustment to various lengths. The frames are usually used with van carrier type vehicles, lift trucks, and crane equipment capable of engaging and transporting by means of a spreader frame such cargo containers, e.g., at freight terminals at which the capability for receiving all available types and sizes of containers for delivery or forwarding further along respective routes of shipment is important. Differences in container lengths have been adapted to accommodate inevitable differences in the size of shipments, the size of carriers, and other factors, in order to contribute flexibility and economy to the handling of freight, particularly in view of standardization of the height and width of all such containers.

Various length containers are made by different manufacturers; for example, containers of 20, 30 and 40 ft. in length are made by one manufacturer, 20, 24 and 40 ft. containers are made by a second, and 20, 35 and 40 ft. containers are made by a third. One expansible spreader frame construction which is adapted to handle a variety of container lengths is covered in U.S. Pat. No. 3,874,719, granted Apr. 1, 1975.

SUMMARY

Our invention comprises a pair of improved compound cylinder and piston assemblies in a telescopic spreader frame for handling cargo containers of a plurality of predetermined lengths in which each cylinder assembly is separated into two coaxial cylindrical portions sealed hydraulically one from the other, one having an extensible piston therein and the other being extensible together with the extensible piston on a fixed supporting piston, the two cylinder assemblies being mounted to operate in opposite directions within various predetermined fixed limits of full extension and retraction, and to one of a plurality of pre-selected fixed positions intermediate full extension and retraction by selected spacer means for assembly with certain cylinder portions of the cylinder assemblies.

It is a principal object of the invention to provide improved compound cylinder and piston assemblies and hydraulic control means therefor for actuating a telescopic container handling spreader frame to a plurality of selectable fixed intermediate positions of extension, as well as to full extension and retraction.

DETAILED DESCRIPTION

Figure 1:
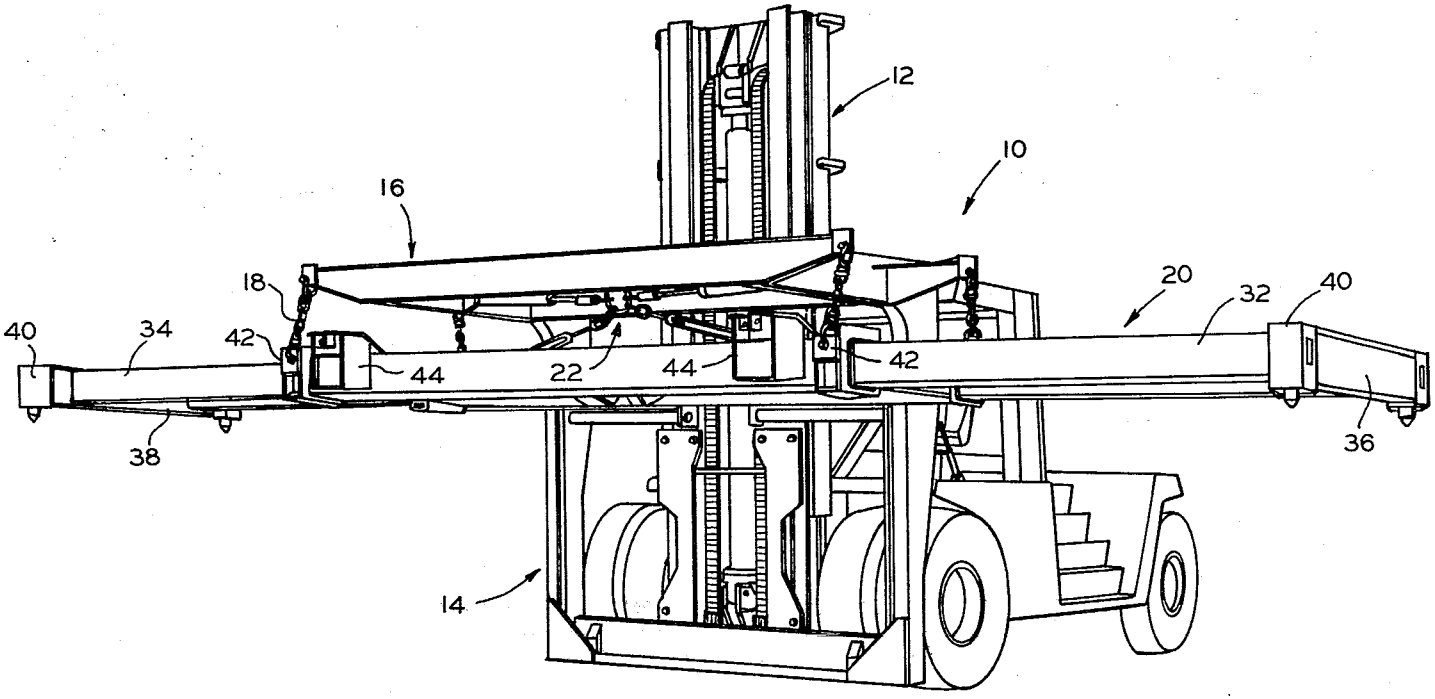
FIG. 1 is a perspective view of one embodiment of the invention as applied to an extensible spreader frame for handling various length containers and mounted as an attachment on the mast of a lift truck.

In FIG. 1 is shown generally a lift truck at numeral 10 having a telescopic mast assembly 12 and a carriage assembly 14 mounted thereon for vertical movement from which is mounted an overhead bridge support assembly 16 suspended from the four corner portions of which by means of chains 18 is an extensible spreader frame assembly 20. Hydraulically actuated shifter means, shown in part at 22, is connected between the bridge support and spreader frame assemblies for controlled shifting of the spreader frame on chains 18. A spreader frame assembly connected as an attachment to a lift truck is disclosed in detail in U.S. Pat. No. 3,764,032, granted Oct. 9, 1973. The spreader frame herein disclosed is also applicable for use with a van carrier, such as is disclosed in U.S. Pat. No. 3,874,719, supra.

Figure 5:
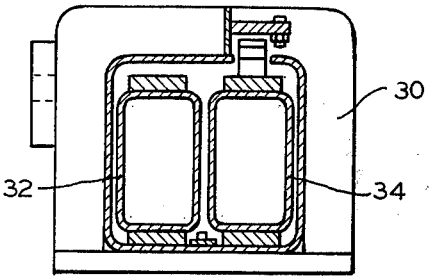
FIG. 5 is a sectional view taken along line 5—5 of FIG. 2.

Spreader frame 20 is generally of a conventional construction except for the hydraulic actuating and control means for extending and retracting the frame. It comprises generally a pair of spaced central hollow fixed beams 30 in each of which is mounted a pair of oppositely slidable and extensible hollow beams 32 and 34, beams 32 having secured to the outer ends thereof a transverse beam 36, and beams 34 secured to outer ends thereof at the opposite end of the spreader frame a transverse beam 36. Pairs of beams 32 and 34 are mounted side-by-side for extension in opposite directions on low friction slide tracks as shown in FIG. 5. At each end of each of transverse beams 36 and 38 is located a twist lock assembly 40 which is operable in a well-known manner to engage corner casting assemblies located at the upper corners of containers which are adapted to be engaged by the spreader frame. Adaptor bracket assemblies 42 are located at each end of each fixed center beam 30, the corresponding ends of which are connected to each other by transverse plates 31, for connection to a chain 18, and additional adaptor bracket assemblies 44 are secured adjacent the end of each beam 30 which are adapted for connection with the lifting means of a van carrier machine.

Figure 6:
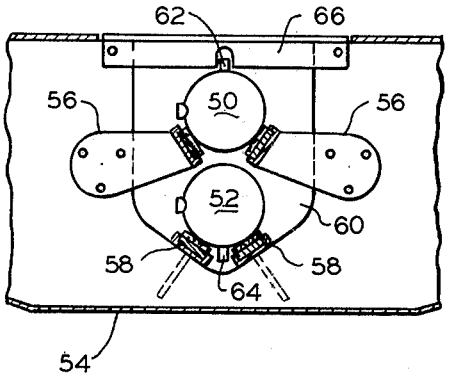
FIG. 6 is a sectional view taken along line 6—6 of FIG. 2.

The device of my invention for extending and retracting sliding beam assemblies 32 and 34 comprises a pair of cylinder assemblies 50 and 52 located in the same vertical plane and supported in the central portions thereof by a transverse plate 54 and pairs of support pads 56 and 58 secured thereto and projecting into openings 60 through which pass the cylinders (FIG. 6). Elongated key members 62 and 64 are secured to upper and lower sides of cylinders 50 and 52 respectively, and register with openings formed in a member 66 and between pads 58 to prevent the cylinders from rotating. Cylinder and piston assembly 50 has its one end pivotally connected to the one transverse beam 31 at 70 and its opposite end pivotally connected to movable beam 36 at 72, while cylinder and piston assembly 52 has its one end connected to the other beam 31 at 74 and its opposite end connected to movable beam 38 at 76.

Each of cylinder and piston assemblies 50 and 52 per se and the control means therefor in combination comprises a unique device, as will now be described primarily in conjunction with FIGS. 7–10. In these figures cylinder assembly 50 is shown as the bottom cylinder and assembly 52 as the top cylinder, which is the reverse of the previous figures, but it is immaterial to the structure and operation of the invention.

Each of cylinder and piston assemblies 50 and 52 comprises a pair of pistons and a pair of cylinders. Assembly 50 comprises a pair of coaxial hydraulic cylinders 80 and 82 which are secured together at the head ends, as by welding, at an intermediate wall 84. Likewise, assembly 52 comprises a pair of coaxial cylinders 86 and 88 secured together at the head ends at a wall 90. Fixed piston and piston rod assemblies 92 and 94 are located in cylinders 82 and 88, respectively, having the rod ends thereof connected at 70 and 74 as previously described. A pair of hydraulically actuatable piston and piston rod assemblies 96 and 98 are located in cylinders 80 and 86, respectively, being adapted to be actuated by pressure fluid from retracted position adjacent the respective walls 84 and 90 to extended positions at the rod ends of the respective cylinders 80 and 86. When pressure fluid is introduced simultaneously into the cylinder chambers on opposite sides of both walls 84 and 90 pistons 96 and 98 are first actuated in opposite directions to maximum extended positions at the rod ends of cylinders 80 and 86, following which the fluid pressure in the head ends of cylinders 82 and 88 causes the cylinder and piston assembly 86, 88 and 98 to be actuated as a rigid unit to the left, as shown, on piston 94, while cylinder and piston assembly 80, 82 and 96 is actuated rigidly as a unit to the right on piston 92, thereby effecting, as in the exemplary embodiment of FIGS. 1–6, an extension of the end beams 36 and 38 from the retracted positions illustrated in FIGS. 2 and 3 to the extended positions illustrated in FIG. 1.

It will be noted that the cylinders are maintained in fully retracted positions on the respective pistons 92 and 94 until pistons 96 and 98 are fully extended because equal pressure fluid exists on both sides of wall members 84 and 90 so long as pistons 96 and 98 are moving. At such time the latter pistons reach fully extended positions the pressure fluid in cylinders 80 and 86 produce a force balance between the pressures acting on the respective wall members and pistons, thereby permitting the pressure fluid in the head ends of cylinders 82 and 88 to act on the wall members 84 and 90 to actuate the respective cylinder and piston assemblies 80, 82, 96 and 86, 88, 98 to full extension on fixed piston assemblies 92 and 94.

Figure 2:
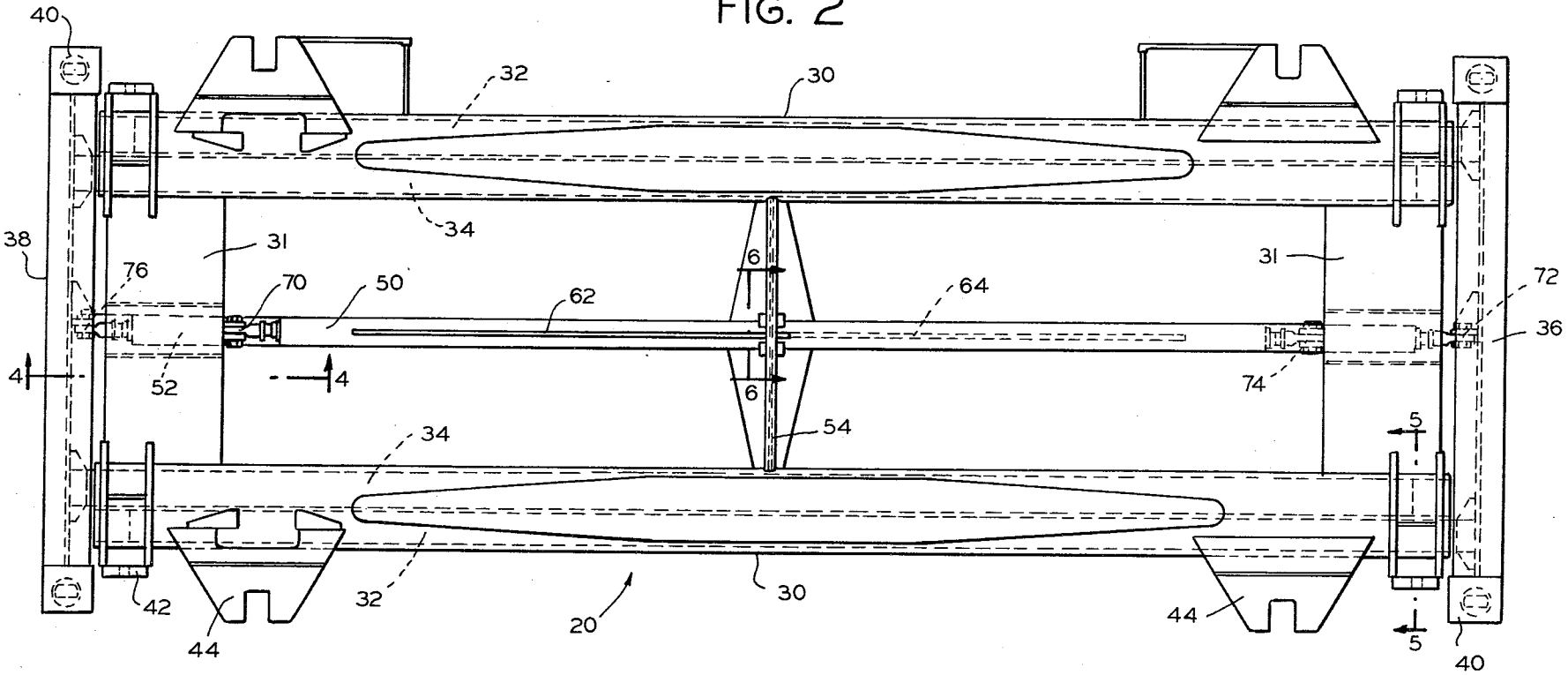
FIG. 2 is a plan view of the spreader frame.
Figure 3:
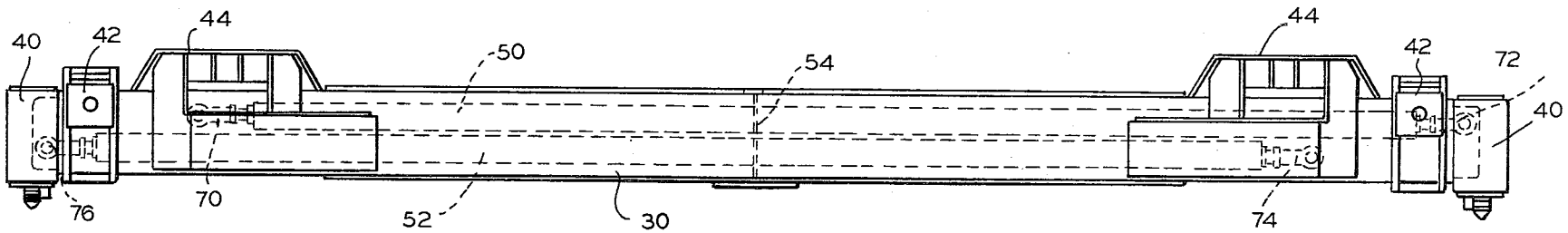
FIG. 3 is a side view of the spreader frame.

In order to fully retract the piston and cylinder assemblies pressure fluid is directed simultaneously to the rod ends of all four cylinders which first effects a full retraction of movable pistons 96 and 98, and then full retraction of the cylinders to return the spreader frame from the FIG. 1 position to the position shown in FIGS. 2 and 3. It will be noted that initial retraction of pistons 96 and 98 is assured by a pressure balanced condition between the opposite rod ends of the respective pairs of cylinders which, upon full retraction of said pistons, effects retraction of the cylinders by the pressure force acting through pistons 96 and 98 on walls 84 and 90.

In order to accomplish the particular objective of the exemplary embodiment as described previously, viz., adaptation of the spreader frame to the handling of a plurality of combinations of container lengths, we utilize in various combinations and sizes, spacer members in the rod ends of certain ones of the cylinders. To best represent our solution to the particular problem posed in the exemplary embodiment which requires a spreader frame and control system capable of being adjusted to handle a first combination of container lengths of 20, 24 and 40 ft., a second set of container lengths of 20, 30 and 40 ft., and a third set of container lengths of 20, 35 and 40 feet, will be described particular dimensions of the cylinders and spacer members to better illustrate the operation of the invention. It will be understood, of course, that all such dimensions are merely for the purpose of illustrating one application of this invention, and in no sense it is intended to constitute a limitation thereof. Also, for convenience in the description which follows the dimensions of exemplary container lengths, and spreader frame and cylinder assembly extensions have been denoted as the same dimensions. In practice, of course, there would be some small differences between the cylinder extension and the container length for any given container engagement, but this is a matter of construction details and immaterial to the invention. The invention is clarified in the description by denoting as equal such dimensions.

Figure 7:
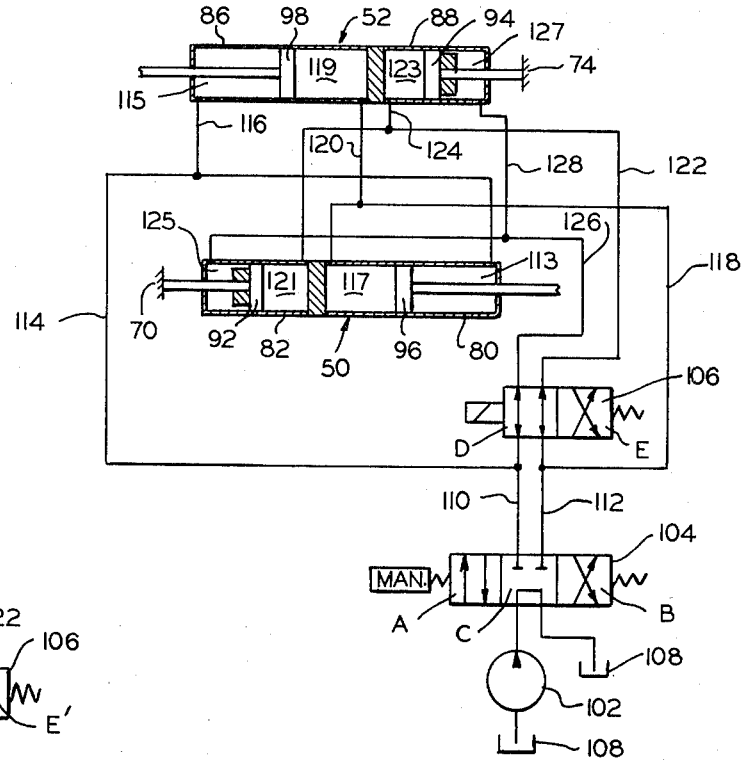
FIG. 7 is a schematic view of the hydraulic system for controlling the extension cylinder means of our invention as embodied in FIGS. 1–6.
Figure 8:
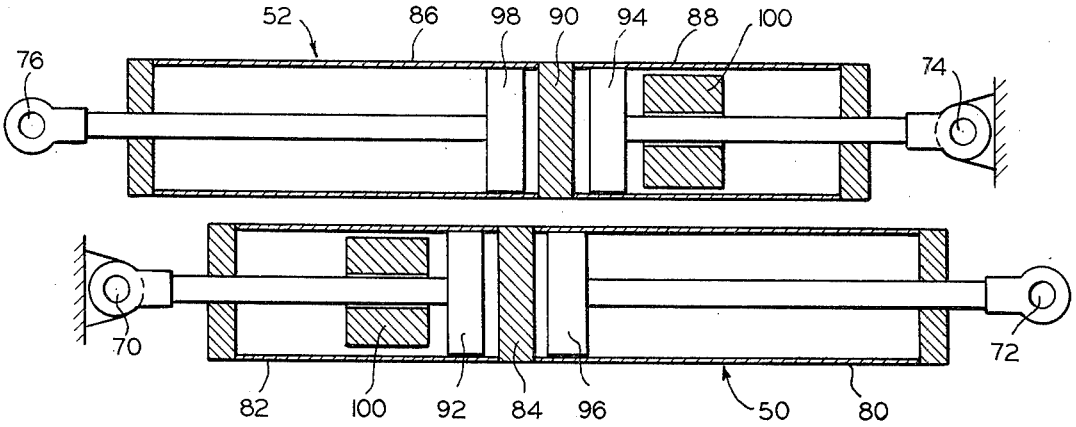
FIGS. 8, 9 and 10 show schematic sectional views of a pair of such cylinder assemblies as are a part of the spreader frame of FIGS. 1–6 wherein each pair of such cylinder assemblies as shown in each figure is modified in relation to the pairs of cylinders as shown in the other figures to establish a different fixed intermediate position of extension.

In the invention as illustrated in FIG. 7–10, as applied to the embodiment of FIGS. 1–6, the maximum travel of pistons 96 and 98 in cylinders 80 and 86 is 8 ft., and the maximum travel of the cylinder assemblies on fixed pistons 92 and 94 is 5 feet. In FIG. 8 a pair of 3 ft. spacers 100 are located on the rod ends of pistons 92 and 94 for the purpose of adjusting the actuation of the spreader frame to an intermediate length of 24 ft. This is accomplished as follows:

In a fully collapsed condition the design and construction is such as to retract fully the spreader frame to an effective length of 20 ft. for handling 20 feet containers. If it is then desired to fully extend the spreader frame to engage a 40 ft. long container pressure fluid is introduced simultaneously into the head ends of the four cylinders as before described, whereupon full extension in opposite directions effects an extension between twist lock elements 40 which may then engage the corner castings of a container 40 feet in length. This, of course, occurs as a result of the 8 extensions in opposite directions of pistons 96 and 98 and the 2 ft. extensions in opposite directions of the cylinder assemblies, the 3 ft. spacers 100 limiting the latter extensions to 2 ft., which, of course, equals a total extension of 20 ft.; i.e., 10 ft. in each direction. If it is now desired to engage a 24 ft. long container, pressure fluid is introduced in a manner to be described into the rod ends only of the 8 ft. stroke cylinders 80 and 86, whereupon pistons 96 and 98 are actuated 8 ft. each in retraction in opposite directions from the 40 ft. extension to retract the spreader frame to a 24 ft. length, the cylinder assemblies remaining in extended positions on pistons 92 and 94.

The hydraulic controls illustrated in FIG. 7 which are adapted to operate the assemblies 50 and 52 comprise a pump 102 connected to a manually controlled three position valve 104 having operating sections A, B, and C, and variously in a manner to be described to the cylinder and piston assemblies 50 and 52 by a plurality of conduits and by a solenoid actuated two position valve 106 having operative sections D and E. Valve 104 in its illustrated open-center position directs the discharge of the continuously running pump 102 back to a reservoir 108. Valves 104 and 106 are connected together by lines 110 and 112, line 110 being in turn connected to the rod ends of cylinders 80 and 86 (chambers 113 and 115) and by conduits 114 and 116, and line 112 being connected to the head ends of cylinders 80 and 86 (chambers 117 and 119) by conduits 118 and 120. Conduits 122 and 124 connect valve 106 to the head ends of cylinders 82 and 88 (chambers 121 and 123), and a pair of conduits 126 and 128 connect valve 106 to the rod ends of cylinders 82 and 88 (chambers 125 and 127).

It will be helpful now to relate the above-described operation of the cylinder assemblies in conjunction with FIG. 8 to the operation of FIG. 7. At all times during operations to extend and retract the spreader frame between 20 and 40 ft. the valve 106 is maintained in its illustrated position, while valve 104 is actuated to operate on section B to extend the cylinder assemblies and spreader frames and operates on section A to retract the same. Thus, with valves 104 and 106 operating on sections B and D to pressurize chambers 121 and 123 by way of conduits 112, 122 and 124, and to also pressurize chambers 117 and 119 by way of conduits 118 and 120, full extension of the spreader frame is effected, the remaining cylinder chambers 113, 115, 125 and 127 being vented to reservoir 108 through the respective conduits 110, 114, 116, 126 and 128 connected through sections D and/or B of valves 106 and 104.

To retract the spreader frame from 40 to 20 ft. valve 104 is actuated to engage section A, valve 106 remaining operative on section D, thus connecting the discharge of the pump to cylinder chambers 113, 115, 125 and 127 and venting the remaining four cylinder chambers to the reservoir.

If it is desired to engage an intermediate length 24 ft. container the spreader frame is first extended to 40 ft., following which valve 104 is actuated to engage section A to retract the frame and valve 106 is actuated to engage section E which limits the retraction of the frame since the pump discharge now communicates with cylinder chambers 121 and 123 by way of valve 106 and with chambers 113 and 115 by way of conduits 110, 114 and 116, the remaining four cylinder chambers venting to the reservoir by way of valve sections E and/or A. Thus, as before explained, pistons 96 and 98 are retracted fully in cylinders 80 and 86 while the cylinder assemblies are maintained in fully extended positions on pistons 92 and 94 thereby effecting a predetermined retraction of the spreader frame to a fixed 24 ft. in the example given. Subsequent full retraction to 20 ft. may then be effected by actuating valve 106 to engage section D.

Figure 9:
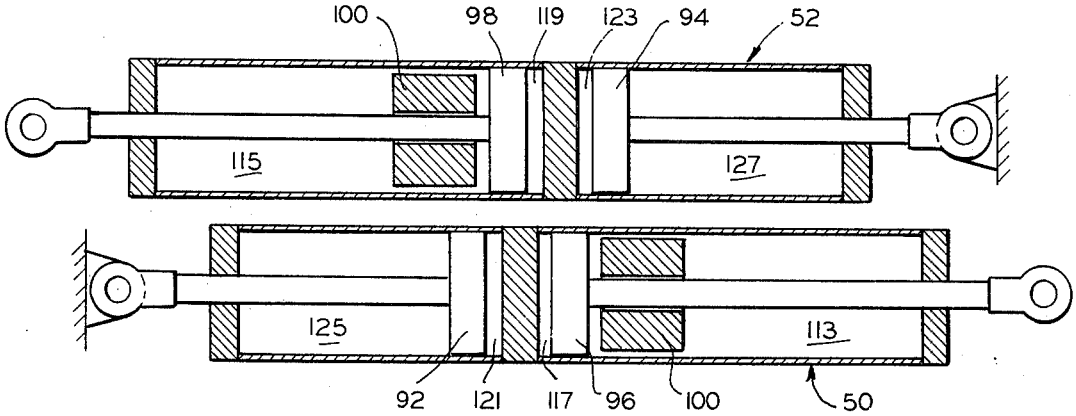
Figure 10:
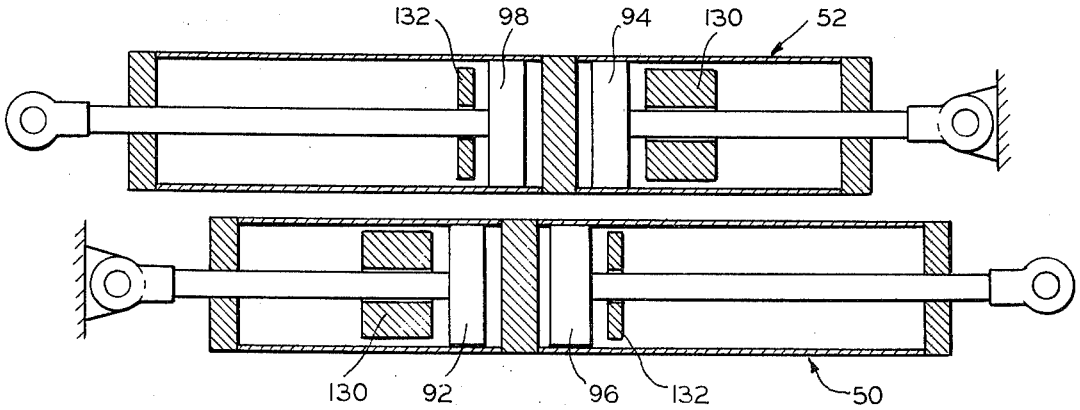

Referring now particularly to FIGS. 9 and 10, the cylinder and piston assemblies 50 and 52 are the same assemblies as shown in FIGS. 7 and 8, the only difference being in the use of piston spacer elements different in length and/or location than spacer elements 100 in the FIG. 8 assembly. As previously explained a second intermediate length container in general use is 30 ft. in length, so that by the simple expedient of reversing the locations of 3 ft. spacer elements 100 from chambers 125 and 127 to chambers 113 and 115 during assembly of the device the same spreader frame becomes adapted to handle containers of 20, 30 and 40 ft. instead of the combination of 20, 24 and 40 ft. of the FIG. 8 assembly. FIG. 9 shows such an arrangement. From the previous description it will be apparent that the extension and retraction of the cylinder assemblies and spreader frame between 20 and 40 ft. is controlled in the same manner as described above in connection with FIGS. 7 and 8. A difference in relative extensions of the pistons and cylinders occurs, of course, as a result of the relocation of spacer elements 100 in that full extension of pistons 96 and 98 now occurs at 5 feet instead of 8 ft., whereas full extension of the cylinder assemblies now occurs at 5 ft. instead of 2 ft., the result being, of course, a full 10 ft., extension of each assembly 50 and 52 in opposite directions to extend the frame from 20 to 40 ft., but with different relative extensions of the piston and cylinder components of each assembly 50 and 52 in FIG. 9 as compared with the same components in FIG. 8.

To position the spreader frame for engagement of 30 feet container the cylinder assemblies are first actuated to extend to 40 ft., following which valves 104 and 106 are actuated to engage sections A and E which, as before described, actuates the extensible pistons 96 and 98 to full retraction while the cylinder assemblies remain at full extension on pistons 92 and 94 which, with spacers 100 located as in FIG. 9, retracts each of said pistons 96 and 98 5 ft. which conditions the spreader frame for engaging a 30 ft. container.

The cylinder assemblies in FIG. 10 are the same as in FIGS. 8 and 9 except that 3 ft. spacers 100 have been replaced by 2½ ft. spacers 130 in chambers 127 and 125, and two 6 inches spacers 132 are located in chambers 113 and 115. This arrangement allows the same spreader frame to handle a combination of containers of 20, 35 and 40 ft. In this instance each of pistons 96 and 98 may travel 7½ ft. and each cylinder unit may travel 2½ ft. on the fixed pistons for a total of 20 ft. in extending the frame to full extension at 40 ft.

Figure 11:
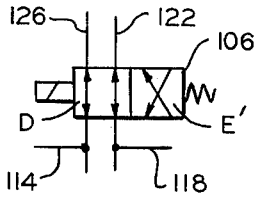
FIG. 11 is a modification of one of the valves of FIG. 7.
Figure 4:
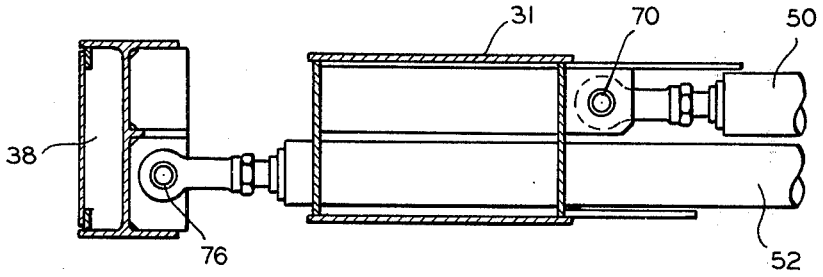
FIG. 4 is a sectional view taken along line 4—4 of FIG. 2.

The operation of the device in use with the 20, 35, 40 ft. spreader frame combination is the same as in respect of the spreader frame combinations associated with FIGS. 7, 8 and 9, except that the hydraulic connections in valve section E are reversed, as shown in FIG. 11, and in operation to retract the spreader frame from 40 to 35 ft. valve 104 is manipulated to engage valve section B instead of valve section A, as is done in actuating the device of FIGS. 8 and 9 from 40 ft. to the intermediate length of 24 and 30 ft., respectively. Thus, retraction to 35 ft. is effected by introducing pressure fluid into chambers 125 and 127 which retracts the cylinder units on fixed pistons 92 and 94 while maintaining pistons 96 and 98 in fully extended positions, thereby retracting from 40 feet a total of 5 ft. In overall operation of the spreader frame with the arrangement of FIGS. 10 and 11, full extension is always available upon engaging valve sections B and D, and full retraction from 40 to 20 ft. is always available upon engaging valve sections A and D, whereas retraction from 40 to 35 ft. is available upon engaging valve sections B and E', and retraction from 35 ft. to 20 ft. is accomplished by then re-engaging valve sections A and D.

It is to be understood that the invention is not limited to the embodiments shown, but may be used in various applications, and that various modifications may be made to suit different requirements, and that other changes, substitutions, additions and omissions may be made in the construction, arrangement and manner of operation of the parts without necessarily departing from the scope of the invention as defined in the following claims.

We claim:

1. In a spreader frame for handling cargo containers of a plurality of predetermined lengths by means of lift trucks, van carriers, and the like, having central fixed beam means, first and second oppositely extending telescopic beam means mounted on said central beam means and first and second transverse beam means secured to the outer end portions of said first and second telescopic beam means adapted to engage such cargo containers, a first compound cylinder and piston assembly operatively connected to the fixed beam means and to the first transverse beam means including a movable cylinder means having first and second coaxial cylinder portions separated by a wall means, an extensible first piston means in said first cylinder portion and a fixed second piston means in said second cylinder portion, a second compound cylinder and piston assembly extending in a direction opposite to the said first cylinder and piston assembly operatively connected to the fixed beam means and to the second transverse beam means including a movable cylinder means having first and second coaxial cylinder portions separated by a wall means, an extensible first piston means in said first cylinder portion and a fixed second piston means in said second cylinder portion, spacer means adapted at the time of assembly of said first and second piston and cylinder assemblies to be assembled in a selected one cylinder portion of each of said cylinder means for establishing a pre-selected intermediate position of each of said first and second cylinder and piston assemblies for engaging a selected one length container, and hydraulic control means for pressurizing said first and second cylinder portions of both said first and second cylinder and piston assemblies such that said first piston means of said first and second assemblies are extended in opposite directions from the respective first cylinder portions thereof and said cylinder means of said first and second assemblies are extended in opposite directions on the respective second piston means, said first and second transverse beam means being actuated by said first and second assemblies to selectively engage cargo containers of relatively short, long and intermediate lengths, the short container being engageable thereby when said first and second assemblies are retracted, the long container being engageable when said first and second assemblies are extended, and the intermediate container being engageable when said first and second assemblies are extended in intermediate position in which said spacer means is operative to fix said intermediate position.

2. An apparatus as claimed in claim 1 wherein said hydraulic control means includes hydraulic pump and valve means for pressurizing the head ends of said first and second portions of both said first and second cylinder and piston assemblies to extend the respective first piston means and the respective cylinder means, and for pressurizing the rod ends of the first and second cylinder portions of the respective first and second cylinder and piston assemblies to retract the first piston means and the cylinder means of the respective first and second cylinder assemblies.

3. An apparatus as claimed in claim 1 wherein said hydraulic control means includes valve means which in a first operative position effects full retraction of said first and second cylinder and piston assemblies, in a second operative position effects full extension of said first and second assemblies, and in a third operative position effects an intermediate extension of said first and second assemblies as established by said spacer means.

4. An apparatus as claimed in claim 1 wherein said first and second piston and cylinder assemblies are mounted substantially coplaner in a vertical plane, and are offset longitudinally one from the other.

5. An apparatus as claimed in claim 1 wherein additional spacer means may be assembled in other cylinder portions of said first and second cylinder and piston assemblies to establish a pre-selected intermediate length of said assemblies.

6. An apparatus as claimed in claim 1 wherein said spacer means may be mounted in said selected one cylinder portions of said first and second cylinder and piston assemblies for enabling the spreader frame to successively engage cargo containers having lengths of substantially 20, 24 and 40 feet.

7. An apparatus as claimed in claim 1 wherein said spacer means may be mounted in selected corresponding cylinder portions of said first and second cylinder and piston assemblies for enabling the spreader frame to successively engage containers having lengths of substantially 20, 35 and 40 ft.

8. An apparatus as claimed in claim 1 wherein said first and second cylinder portions of each said first and second piston and cylinder assemblies are of different lengths.

9. An apparatus as claimed in claim 1 wherein a plurality of said spacer means of varying length may be mounted in selected cylinder portions of said first and second cylinder and piston assemblies for further modifying and fixing the intermediate position of said spreader frame.

10. An apparatus as claimed in claim 1 wherein said hydraulic control means includes pump means, first and second valve means, and conduit means variously connecting said first and second valve means to the first and second cylinder portions of each said first and second cylinder and piston assemblies.

11. An apparatus as claimed in claim 10 wherein a first portion of said conduit means connects certain of said cylinder portions of said first and second assemblies from hydraulically intermediate said first and second valve means, and a second conduit portion of said conduit means connects certain of said cylinder portions of said first and second assemblies from downstream of said first and second valve means.

12. An apparatus as claimed in claim 10 wherein a first position of each of said first and second valve means actuates said first and second assemblies in one direction, and a second position of said first valve means and said first position of said second valve means actuates said first and second assemblies in an opposite direction.

13. An apparatus as claimed in claim 12 wherein one of said positions of said first valve means combines with a second position of said second valve means to actuate said first and second assemblies to and intermediate position.

14. In a spreader frame for handling cargo containers of a plurality of predetermined lengths by means of lift trucks, van carriers, and the like, having central fixed beam means, first and second oppositely extending telescopic beam means mounted on said central beam means and first and second transverse beam means secured to the outer end portions of said first and second telescopic beam means adapted to engage such cargo containers, a first compound cylinder and piston assembly operatively connected to the fixed beam means and to the first transverse beam means including a movable cylinder means having first and second coaxial cylinder portions separated by a wall means, an extensible first piston means in said first cylinder portion, a fixed second piston means in said second cylinder portion and a spacer means of predetermined length mounted in one of said cylinder portions, a second compound cylinder and piston assembly extending in a direction opposite to the said first cylinder and piston assembly operatively connected to the fixed beam means and to the second transverse beam means including a movable cylinder means having first and second coaxial cylinder portions separated by a wall means, an extensible first piston means in said first cylinder portion, a fixed second piston means in said second cylinder portion and a spacer means having a predetermined length mounted in one of said cylinder portions corresponding to the location of the spacer means in said first cylinder and piston assembly, and hydraulic control means for pressurizing said first and second cylinder portions of both said first and second cylinder and piston assemblies such that said first piston means of said first and second assemblies are extended in opposite directions from the respective first cylinder portions thereof and said cylinder means of said first and second assemblies are extended in opposite directions on the respective second piston means, said first and second transverse beam means being actuated by said first and second assemblies to selectively engage cargo containers of relatively short, long and intermediate lengths, the short container being engageable thereby when said first and second assemblies are retracted, the long container being engageable when said first and second assemblies are extended, and the intermediated container being engageable when said first and second assemblies are extended in intermediate positions in which the respective said spacer means are operative to fix said intermediate positions, said hydraulic control means including pump means, first and second valve means, and conduit means variously connecting said first and second valve means to the first and second cylinder portions of each said first and second cylinder and piston assemblies, a first portion of said conduit means connecting certain of said cylinder portions of said first and second assemblies from hydraulically intermediate said first and second valve means, and a second conduit portion of said conduit means connecting certain of said cylinder portions of said first and second assemblies from downstream of said first and second valve means.

15. An apparatus as claimed in claim 14 wherein a first position of each of said first and second valve means actuates said first and second assemblies in one direction, and a second position of said first valve means and said first position of said second valve means actuates said and second assemblies in an opposite direction.

16. An apparatus as claimed in claim 15 wherein one of said positions of said first valve means combines with a second position of said second valve means to actuate said first and second assemblies to an intermediate position.

17. An apparatus as claimed in claim 14 wherein said first and second piston and cylinder assemblies are mounted substantially coplaner in a vertical plane, and are offset longitudinally one from the other.

18. An apparatus as claimed in claim 14 wherein said first and second cylinder portions of each said first and second piston and cylinder assemblies are of different lengths, and the respective said spacer means may be assembled in corresponding chambers of first selected cylinder portions to fix a first intermediate position of the spreader frame, and may be mounted in corresponding chambers of second selected cylinder portions to fix a second intermediate position of the spreader frame.

19. An apparatus as claimed in claim 18 wherein a plurality of said spacer means of varying length may be mounted in selected cylinder portions of said first and second cylinder and piston assemblies for further modifying and fixing the intermediate position of said spreader frame.

* * * * *